US007758356B2

(12) United States Patent
Burris et al.

(10) Patent No.: US 7,758,356 B2
(45) Date of Patent: Jul. 20, 2010

(54) COAXIAL CABLE CONNECTOR WITH ELECTRICAL GROUND

(75) Inventors: Donald Andrew Burris, Peoria, AZ (US); Brian Lyle Kisling, Phoenix, AZ (US); William Bernard Lutz, Glendale, AZ (US); Thomas Dewey Miller, Peoria, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 982 days.

(21) Appl. No.: 11/386,336

(22) Filed: Mar. 21, 2006

(65) Prior Publication Data

US 2006/0281348 A1 Dec. 14, 2006

Related U.S. Application Data

(60) Provisional application No. 60/690,642, filed on Jun. 14, 2005.

(51) Int. Cl.
*H01R 13/648* (2006.01)

(52) U.S. Cl. ..... 439/95; 439/578

(58) Field of Classification Search ..... 439/108, 439/578, 584, 585, 101, 810, 814, 92, 95, 439/583

See application file for complete search history.

(56) References Cited

U.S. PATENT DOCUMENTS

| | | | | |
|---|---|---|---|---|
| 3,963,322 | A | 6/1976 | Gryctko | 339/272 |
| 3,967,872 | A | 7/1976 | Mooney et al. | 339/14 |
| 4,325,598 | A | 4/1982 | Leonardo | 339/14 L |
| 4,776,808 | A | 10/1988 | Davidson | 439/100 |
| 4,780,096 | A * | 10/1988 | Franks, Jr. | 439/813 |
| 4,875,864 | A * | 10/1989 | Campbell | 439/100 |
| 5,433,627 | A | 7/1995 | Guerra et al. | 439/582 |
| 5,480,311 | A * | 1/1996 | Luu | 439/100 |
| 5,494,462 | A * | 2/1996 | Auclair | 439/810 |
| 5,929,383 | A * | 7/1999 | Marik et al. | 174/78 |
| 6,089,912 | A | 7/2000 | Tallis et al. | 439/584 |
| 6,422,900 | B1 | 7/2002 | Hogan | 439/578 |
| 6,710,673 | B1 * | 3/2004 | Jokerst | 333/12 |
| 6,790,081 | B2 | 9/2004 | Burris et al. | 439/578 |

(Continued)

FOREIGN PATENT DOCUMENTS

| | | |
|---|---|---|
| FR | 1595943 | 12/1968 |

(Continued)

*Primary Examiner*—Edwin A. Leon
*Assistant Examiner*—Vanessa Girardi
(74) *Attorney, Agent, or Firm*—Joseph M. Homa; Matthew J. Mason

(57) ABSTRACT

A coaxial cable connector includes a bonding block lug for receiving a grounding wire. The connector includes a body portion for receiving the end of a cable, a nut for securing the connector to a mating coaxial port, a post extending within the body portion for extending into the cable, a lug secured to the body portion and having a first hole for receiving the grounding wire, and a clamp element for clamping the grounding wire within the lug. The lug may include a second hole that intersects the first hole. The clamp element may be a set screw, press-fit pin, or the like extending within the second hole for selectively engaging the grounding wire. The set screw may incorporate security features to prevent removal of the grounding wire. The bonding block lug can be incorporated within a variety of connectors, including axially-compressed connectors.

23 Claims, 13 Drawing Sheets

U.S. PATENT DOCUMENTS

| | | | | |
|---|---|---|---|---|
| 6,916,200 | B2 | 7/2005 | Burris et al. | 439/578 |
| 7,048,579 | B2 * | 5/2006 | Montena | 439/578 |
| 7,108,548 | B2 | 9/2006 | Burris et al. | 439/578 |
| 7,128,603 | B2 | 10/2006 | Burris et al. | 439/578 |
| 2003/0211778 | A1 * | 11/2003 | Burris et al. | 439/587 |
| 2004/0203288 | A1 | 10/2004 | Fan et al. | 439/607 |
| 2006/0166552 | A1 * | 7/2006 | Bence et al. | 439/578 |

FOREIGN PATENT DOCUMENTS

| | | |
|---|---|---|
| JP | 2000-182728 | 12/1998 |

* cited by examiner

COAXIAL CABLE CONNECTOR WITH ELECTRICAL GROUND

CROSS-REFERENCE TO RELATED APPLICATIONS

This application claims the benefit of priority under 35 U.S.C. §119(e) to U.S. Provisional Application Ser. No. 60/690,642 filed on Jun. 14, 2005, the content of which is relied upon and incorporated herein by reference in its entirety.

BACKGROUND OF THE INVENTION

1. Field of the Invention

The present invention relates generally to coaxial cable connectors and bonding blocks used to connect a ground lead of the coaxial cable system to a source of ground.

2. Technical Background

Certain coaxial cable applications, such as cable television (CATV) systems, require that the coaxial cable system be coupled to an electrical ground to safely conduct high voltages, resulting from lightning strikes or the like, to ground, and thereby avoid damage to the coaxial cable system. Bonding blocks are often used to attach coaxial cable connectors to a grounding source such as a copper wire terminated to ground. Current bonding blocks are typically attached to a double-ended female connector. One example of such current bonding blocks is the line of 1 GHz splice and ground block devices commercially available from TVC Communications of Annville, Pa., e.g., splice and ground block device Model No. G2B2. These double-ended female connectors attach to a base structure such as a house or network interface device, and also attach to a grounding wire. Each end of the double-ended female connector is attached to a mating male connector, and the grounding wire is inserted into a hole in the bonding block and secured by a set screw. In addition, the bonding block includes mounting holes for receiving one or more mounting screws used to physically secure the bonding block to a support structure.

Conventional bonding block devices, of the type described above, suffer from several disadvantages. First, they require considerable physical space to accommodate the necessary hardware. They also require considerable manipulation and time to install. Moreover, each interconnection along the coaxial cable path presents a risk of signal degradation, as well as additional coaxial connectors, and conventional bonding blocks require two additional interconnections within the coaxial cable path each time a bonding block is introduced.

Accordingly, it is an object of the present invention to provide a bonding block for making a ground connection to a coaxial cable system that is more compact, and requires less mounting space, than conventional bonding blocks that are presently available.

Another object of the present invention is to provide such a bonding block which eliminates the need to mount the bonding block to a support structure, thereby saving time and effort by the installer.

Yet another object of the present invention is to provide such a bonding block that can be installed easily and quickly.

These and other objects of the present invention will become more apparent to those skilled in the art as the description of the present invention proceeds.

SUMMARY OF THE INVENTION

Briefly described, and in accordance with a preferred embodiment thereof, the present invention relates to a coaxial cable connector adapted to receive a grounding wire, and including a body portion having first and second opposing ends, the second end of the body portion being adapted to receive a prepared end of a coaxial cable. The coaxial cable connector also includes a nut rotatably secured about the first end of the body portion for securing the coaxial cable connector to a mating coaxial port, such as a threaded equipment port. The coaxial cable connector also includes a post that extends generally within the body portion. The post has a first end secured to the first end of the body portion, and an opposing second end for extending within a coaxial cable. A lug is secured to the body portion in a manner which allows the lug to be in electrical contact with the body portion. The lug includes a first hole for receiving a grounding wire. A clamp element communicates with the first hole of the lug for clamping the grounding wire within the lug. Thus, the coaxial cable connector connects the prepared end of a coaxial cable to a coaxial port, and the clamp element secures the grounding wire within the first hole of the lug.

In one embodiment of the present invention, the lug includes a second hole that intersects with the first hole of the lug. The clamp element is selectively advanced through the second hole until it bears against the grounding wire disposed in the first hole of the lug. The clamp element may take the form, for example, of a grounding screw, or set screw, in which case, the second hole of the lug is preferably threaded for threadedly-engaging the grounding screw. Alternatively, the clamp element may be a press-fit pin that is driven into the grounding wire via a compression tool.

In order to prevent unauthorized persons from removing the grounding wire from the lug of the connector, the grounding screw may incorporate a break-away head that fractures when the rotational force applied thereto has exceeded a predetermined amount of force needed to ensure that the grounding wire is sufficiently secured. Once the head of the grounding screw breaks off, it is much more difficult to unthread the grounding screw from the lug.

In one preferred embodiment, the lug is either press-fit over, or made integral with, the body portion of the coaxial cable connector. In another preferred embodiment, the connector is formed as an axial-compression style connector, including an electrically-conductive compression ring slidably secured over the second end of the body portion, and axially movable with respect thereto, for compressing the outer protective jacket and outer conductor of the coaxial cable against the second end of the post as the compression ring is axially advanced toward the nut. In this embodiment, the lug may be secured to, and in electrical contact with, the compression ring. The compression ring is, in turn, secured over, and in electrical contact with, the body portion of the coaxial cable connector.

The aforementioned grounding lug may also be incorporated within coaxial cable connectors of the type that include so-called "pop-up pins", i.e., connectors that include a slidable center conductor pin, one end of which receives and engages the center conductor of the coaxial cable, and the opposite end of which is selectively advanced to extend within the nut to engage a center conductor of the coaxial port.

In a further embodiment of the present invention, the aforementioned grounding screw is omitted. Instead, a two-piece lug member is used to secure a grounding wire to the connector. A first lug member is secured to the body portion of the connector and includes a first hole for receiving a portion of the grounding wire. A second lug member is included as part of a compression ring and includes a second hole axially aligned with the first hole in the first lug member. The second hole of the second lug member also receives a portion of the grounding wire. This second lug member including a tapered port surrounding the second hole formed therein, and such tapered port is adapted to enter the first hole of the first lug member as the compression ring is axially advanced toward the nut. The tapered port is compressed inwardly by the first hole of the first lug member during such axial compression for gripping the grounding wire. Preferably, the first lug member is integral with the body portion, and the second lug member is integral with the compression ring.

In a yet further embodiment of the present invention, the grounding lug is a deformable lug that is crimped around the grounding wire to retain the grounding wire in physical and electrical contact with the coaxial connector.

DETAILED DESCRIPTION OF THE PREFERRED EMBODIMENTS

Figure 1:
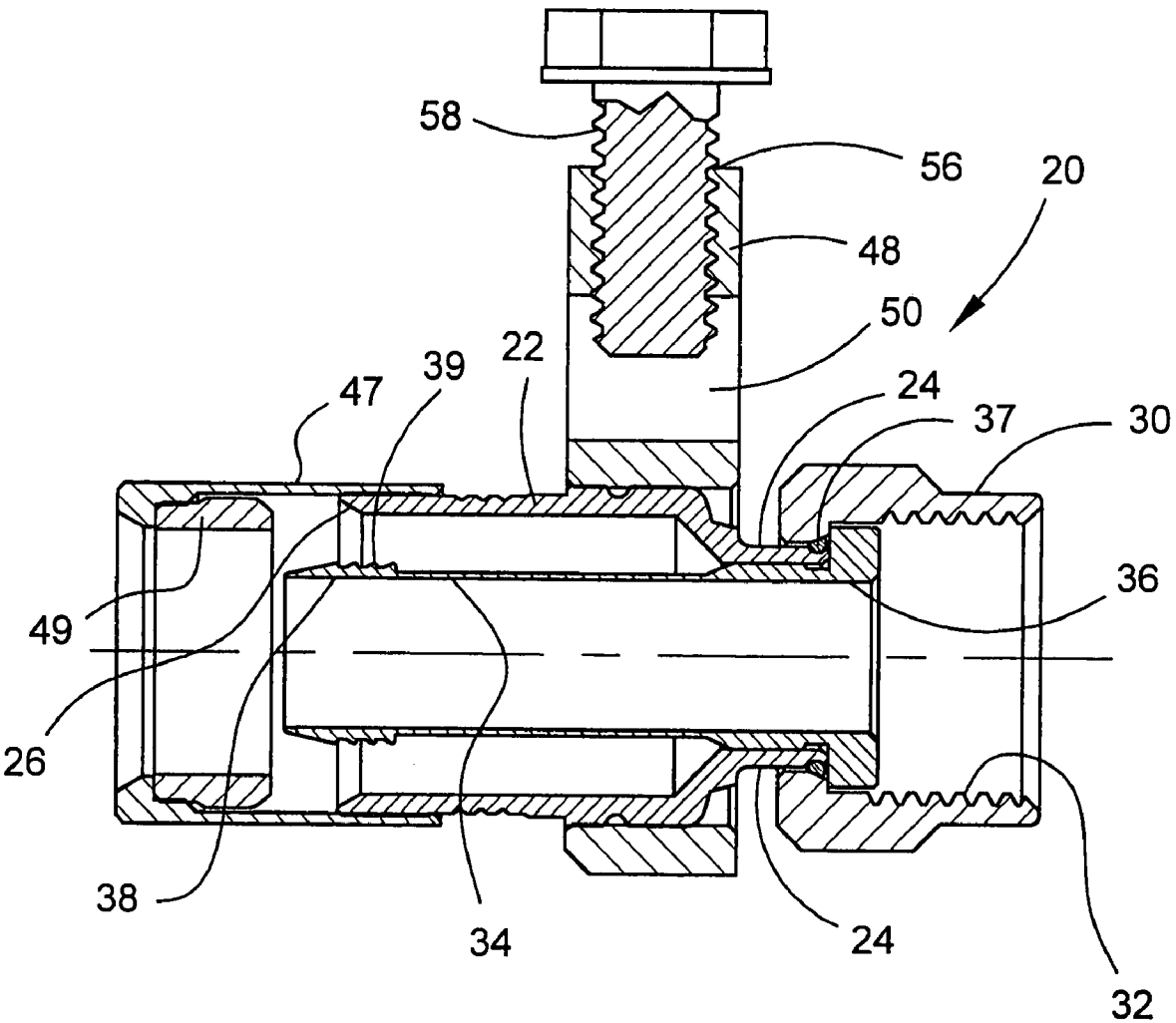
FIG. 1 is a cross-sectional drawing of a coaxial cable connector incorporating a bonding block for a grounding wire in accordance with a first embodiment of the present invention.

Referring to FIGS. 1-3 and FIG. 8, a coaxial cable connector, designated generally by reference numeral 20, is shown having a grounding lug. Connector 20 includes a generally-cylindrical body portion 22 having first end 24 and and opposing second end 26. Second end 26 is adapted to receive the prepared end of a coaxial cable 28 (see FIGS. 2 and 3). Body portion 22 is made of metal, is electrically conductive, and in a preferred embodiment, is made from brass.

Connector 20 also includes a coupler 30, shown as a nut, rotatably secured about first end 24 of body portion 22 for securing coaxial cable connector 20 to a mating coaxial port (not shown), such as an equipment port of a terminal box. Coupler 30 is internally threaded, the internal threads being designated by reference numeral 32. While coupler 30 is illustrated as a conventional internally-threaded nut of the type commonly used for a so-called "F-connector", nut 30 could also be a BNC coupler or similar type of fastener, and the term "coupler" as used in this application is intended to include all of such coupling devices. In a preferred embodiment, coupler 30 is made of brass.

Figure 8:
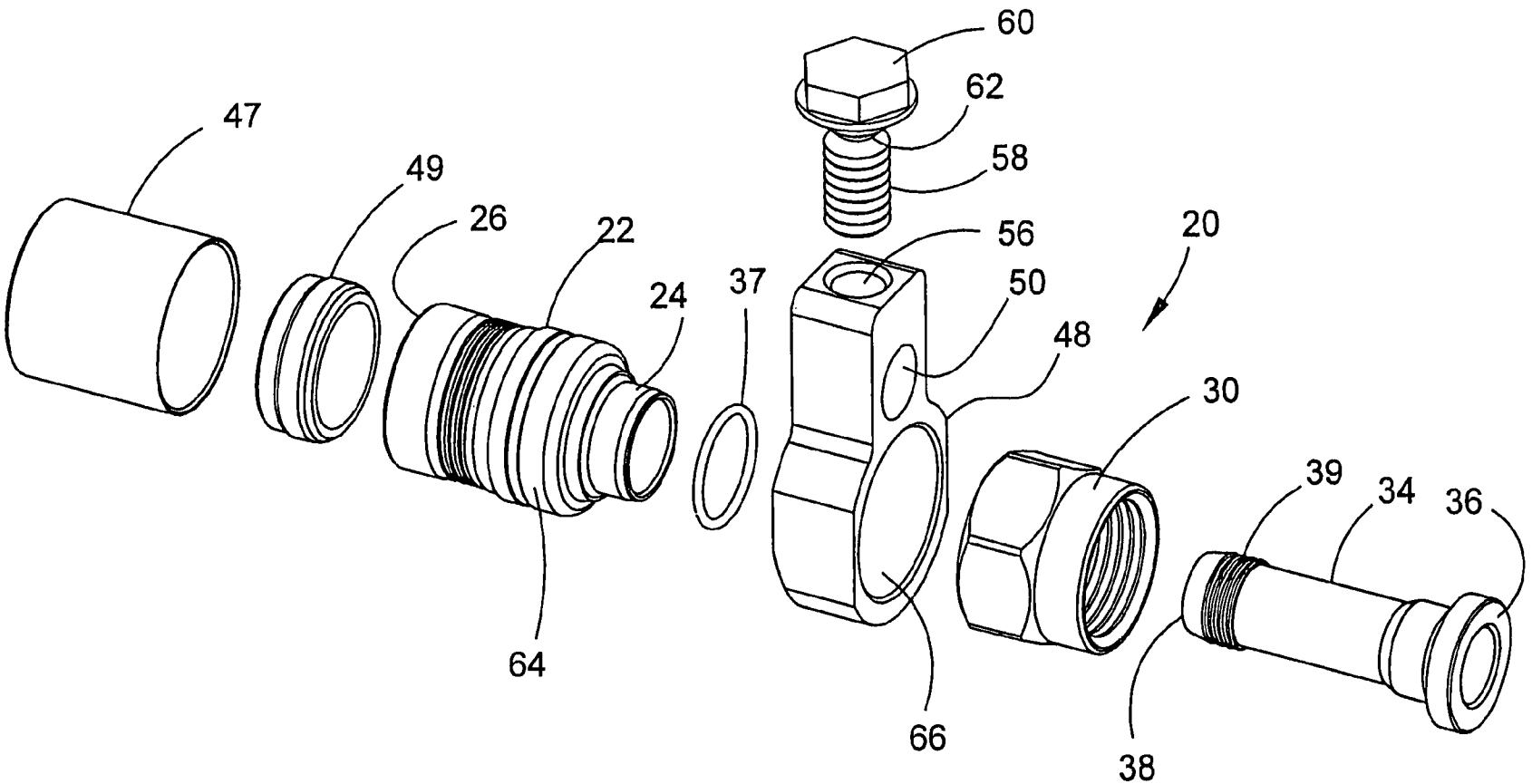
FIG. 8 is an exploded perspective view of the coaxial connector shown in FIGS. 1-3.

Connector 20 further includes a tubular post member 34 extending within body portion 22. The first end 36 of post 34 is secured to first end 24 of body portion 22. The opposing second end 38 of post 34 is adapted to extend within the prepared end of coaxial cable 28, just over the dielectric layer 40 thereof, and just below the braided outer conductor 42 (see FIGS. 2 and 3). Tubular post is metallic, and in a preferred embodiment, is made of brass. As is further shown in FIGS. 2 and 3, coaxial cable 28 includes a center conductor 44 that extends through coupler 30, as well as a protective outer jacket 46. As shown in FIGS. 1 and 8, an elastomeric O-ring seal 37 is seated on first end 24 of body portion 22 proximate first end 36 of tubular post 34, and adjacent coupler 30. When coupler 30 is tightened onto a mating coaxial equipment port, O-ring 37 is compressed against body portion 22, post 34 and coupler 30, forming a moisture-proof seal therebetween.

Figure 2:
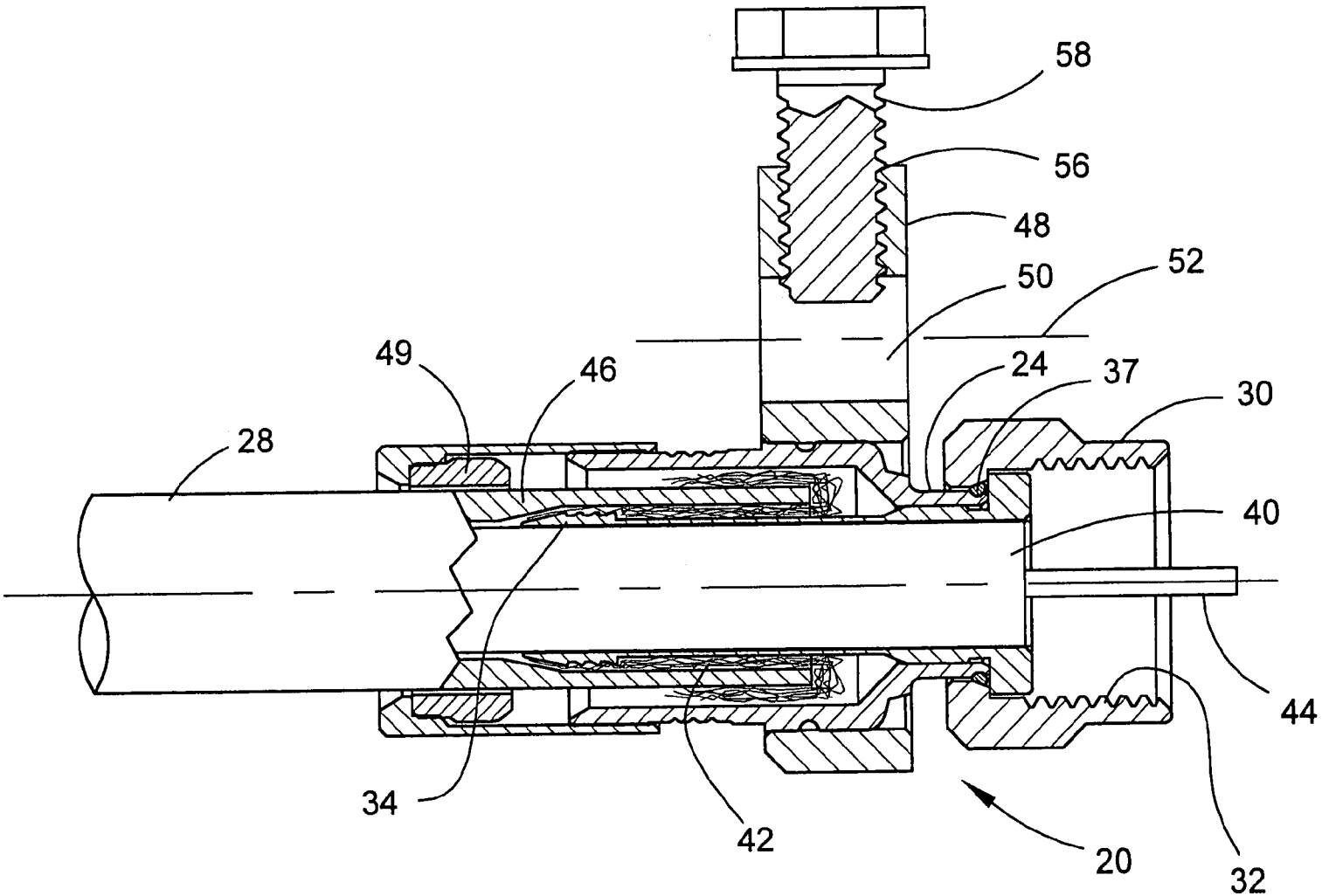
FIG. 2 is a cross-sectional drawing of the coaxial cable connector of FIG. 1 following insertion of the prepared end of a coaxial cable therein.
Figure 3:
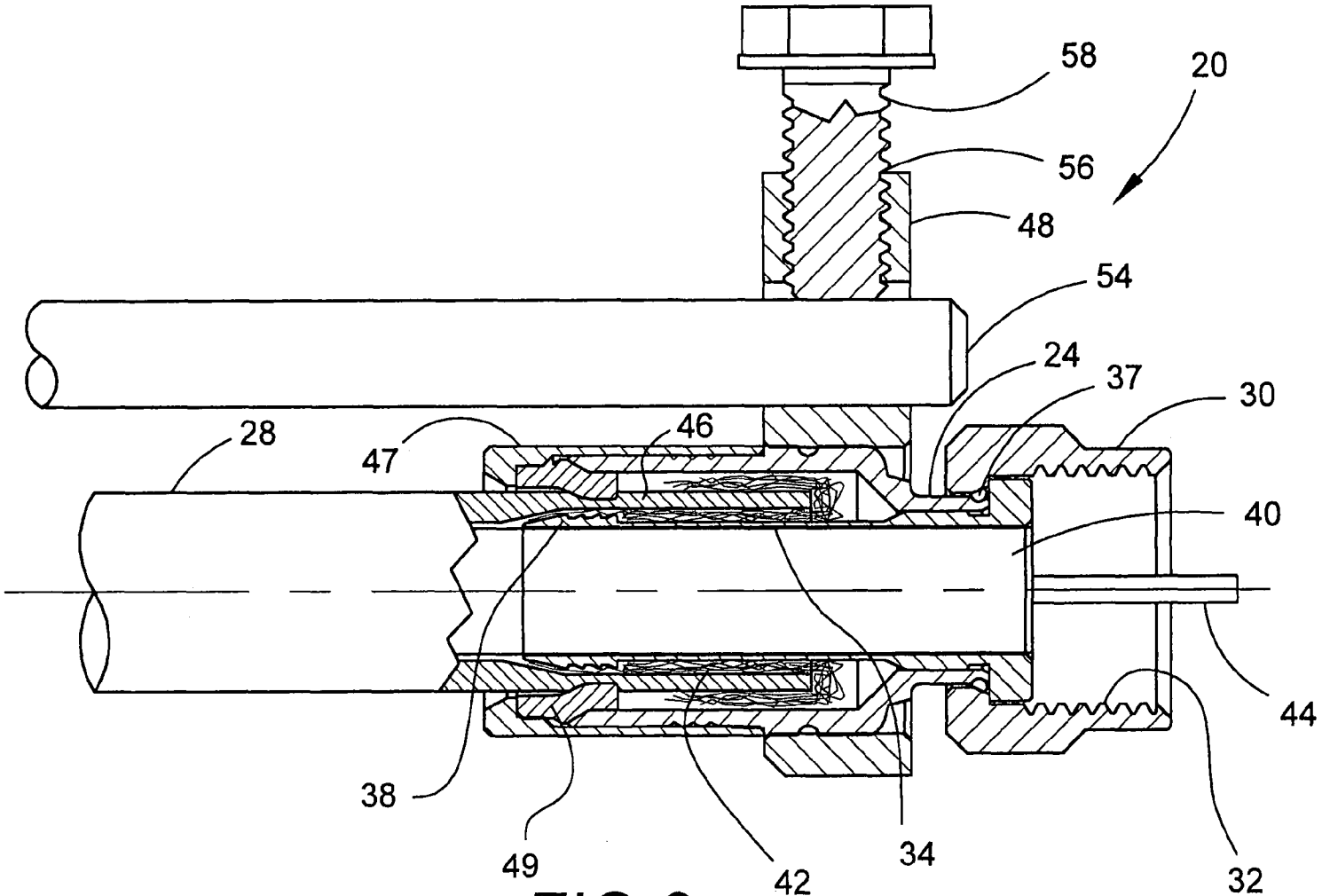
FIG. 3 is a cross-sectional drawing of the coaxial cable connector of FIGS. 1 and 2 following axial compression of the connector, insertion of a grounding wire, and tightening of a grounding screw.

Referring to FIGS. 1-3 and 8, coaxial connector 20, in a preferred embodiment, also includes a tubular body or compression sleeve 47 and a gripping member 49 for securing the prepared end of coaxial cable 28 to coaxial connector 20. Compression sleeve 47 is made of metal or rigid plastic and is initially mounted over second end 26 of body portion 22. Gripping member 49 is made of a deformable elastomeric material and is supported within the rearmost end of compression sleeve 47. As shown in FIG. 2, the prepared end of coaxial cable 28 is inserted through compression sleeve 47, through gripping member 49, and into second end 26 of body portion 22. The dielectric 40, and center conductor 44, of coaxial cable 28 pass through the center of tubular post 34, while outer conductor 42 and protective jacket 46 pass around the outside of tubular post 34. Then, as indicated in FIG. 3, compression sleeve 47 is axially-compressed toward coupler 30, using a conventional coaxial connector axial compression tool, to compress gripping member 49 between body portion 22 and protective jacket 46 of coaxial cable 28. It will be noted that second end 38 of tubular post 34 has a series of barbs 39 that engage outer conductor 42 as gripping member 49 is compressed toward tubular post 34. Following the axial compression step, gripping member 49 forms a moisture-proof seal between body portion 22 and protective jacket 46 of coaxial cable 28.

Still referring to FIGS. 1-3 and also FIG. 8, connector 20 also includes a grounding lug 48 secured to, and in electrical contact with, body portion 22. Grounding lug 48 includes a first hole 50 extending along axis 52 (see FIG. 2) for receiving grounding wire 54 (see FIG. 3). Preferably, first hole 50 is a through hole. In other embodiments, hole 50 is a longitudinal groove. Grounding wire 54 extends to a preferred source of ground for shunting undesirably or dangerously high voltages thereto. In order to retain grounding wire 54 within first hole 50, a second hole 56 is formed in lug 50 and intersecting with first hole 50. Preferably, second hole 56 is perpendicular to first hole 50. Second hole 56 is adapted to receive a clamp element that communicates with first hole 50 of lug 48, selectively engaging grounding wire 54 in first hole 50 of lug 48 and clamping grounding wire 54 therein. Within the embodiment shown in FIGS. 1-3, second hole 56 is threaded, and the clamp element is a threaded grounding screw, or set screw, 58 that threadedly-engages second hole 56. In a preferred embodiment, grounding lug 48 is made of brass, and grounding screw 58 is preferably made from steel. Following axial compression of coaxial connector 20 to secure coaxial cable 28 thereto in the manner described above, grounding wire 54 is inserted into first hole 50 of grounding lug 48, and then grounding screw 58 is tightened to clamp grounding wire 54 within lug 48.

Figure 10:
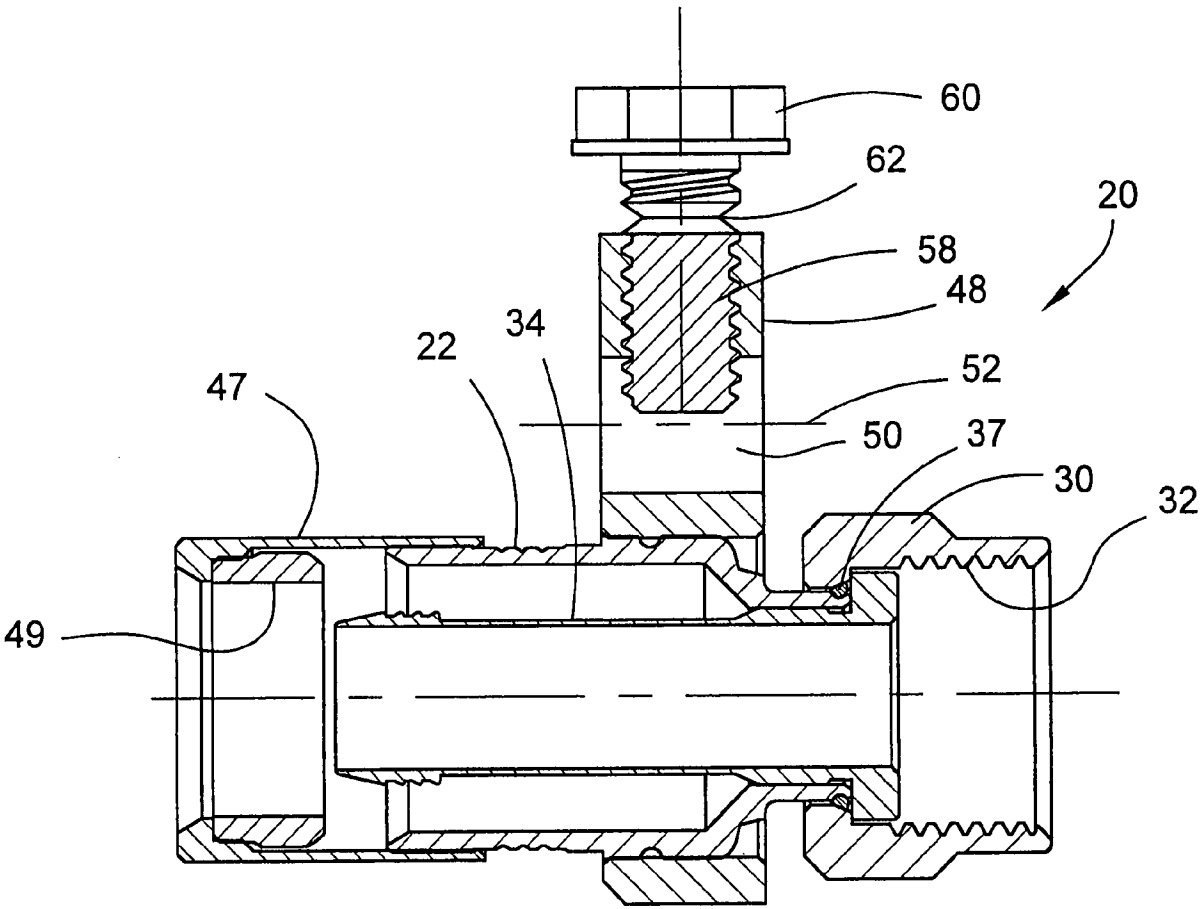
FIG. 10 is a cross-sectional drawing of a coaxial cable connector of the general type shown in FIGS. 1-3 but wherein a grounding screw having a break-away head is provided to discourage removal of the grounding wire from the grounding lug following installation.

Some preferred embodiments of the present invention help to prevent unauthorized personnel from tampering with the grounding of the connector through the grounding wire, e.g. by removing grounding wire 54 from grounding lug 48. Referring to FIGS. 8 and 10, grounding screw 58 preferably incorporates a break-away head portion 60 that, in some preferred embodiments, includes a weakened, reduced diameter portion 62 that fractures and shears off when a predetermined amount of rotational force is applied to head 60 after the bottom of grounding screw 58 engages grounding wire. This predetermined amount of force is set to be a force which ensures that grounding screw 58 has been sufficiently tightened to clamp grounding wire 54 within first hole 50 of lug 48. Once break-away screw head 60 shears off during or after installation of the grounding wire within the lug, it is much more difficult to remove the base portion of grounding screw 58 from threaded second hole 56.

As shown best in FIG. 8, in some preferred embodiments such as those shown in FIGS. 1-3, grounding lug 48 includes a central bore 66 having an internal diameter that is slightly smaller than the outer diameter of shoulder region 64 of body portion 22. Central bore 66 of grounding lug 48 is press-fit over shoulder region 64 of body portion 22 to secure lug 48 to body portion 22, and to ensure that such components are in electrical contact with each other.

Figure 5:
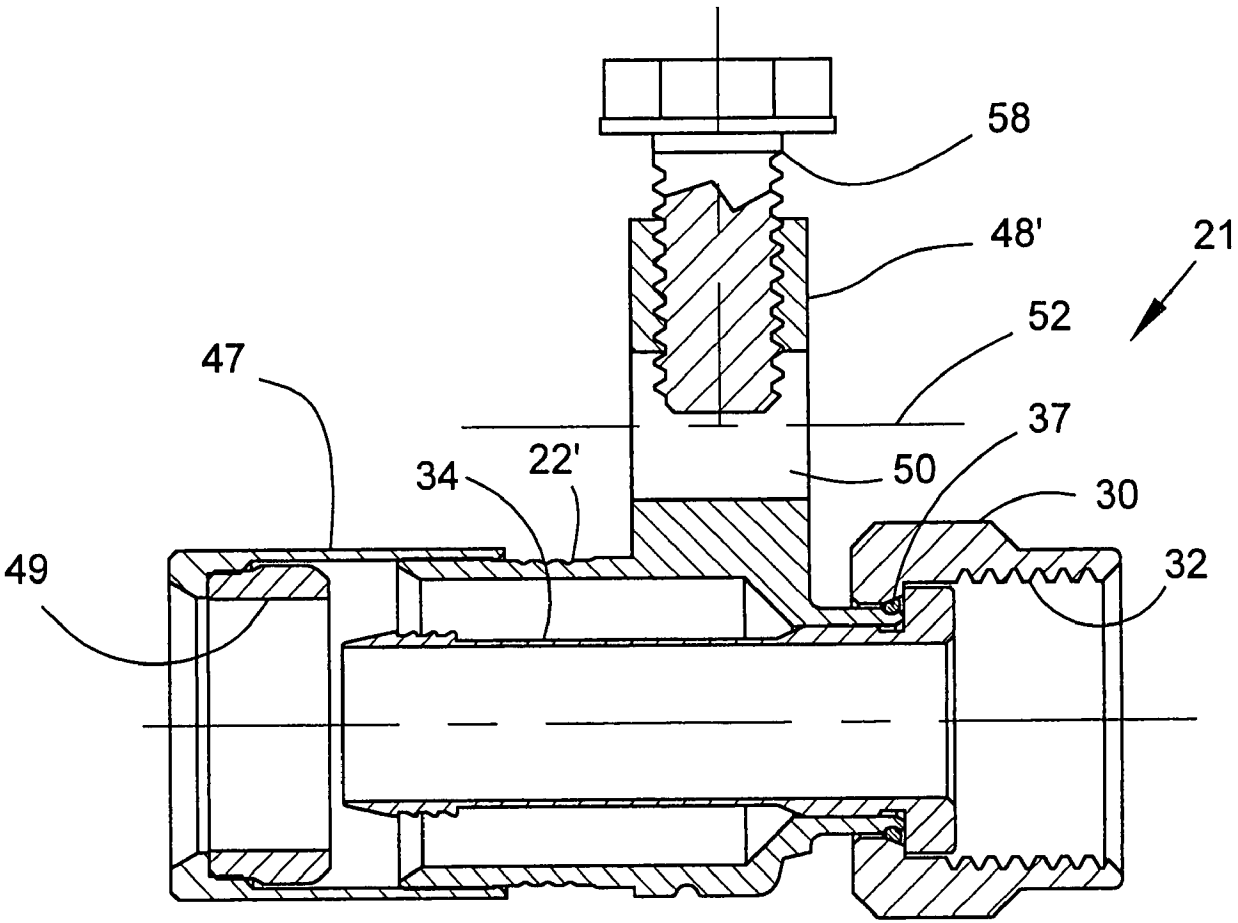
FIG. 5 is a cross-sectional drawing of a coaxial cable connector of the general type shown in FIG. 1 but wherein the bonding block lug is integral with the body portion of the coaxial connector.

In other preferred embodiments, grounding lug 48 and body portion 22 are fabricated as an integral unit, as by machining metal stock in the manner shown in FIG. 5. Coaxial connector 21 shown in FIG. 5 includes many features similar to those already described above in conjunction with FIGS. 1-3, and like reference numerals appear in FIG. 5 to designate similar or identical features. As shown in FIG. 5, body portion 22' and lug 48' are integral with each other and are machined from a single piece of metal stock.

Figure 12:
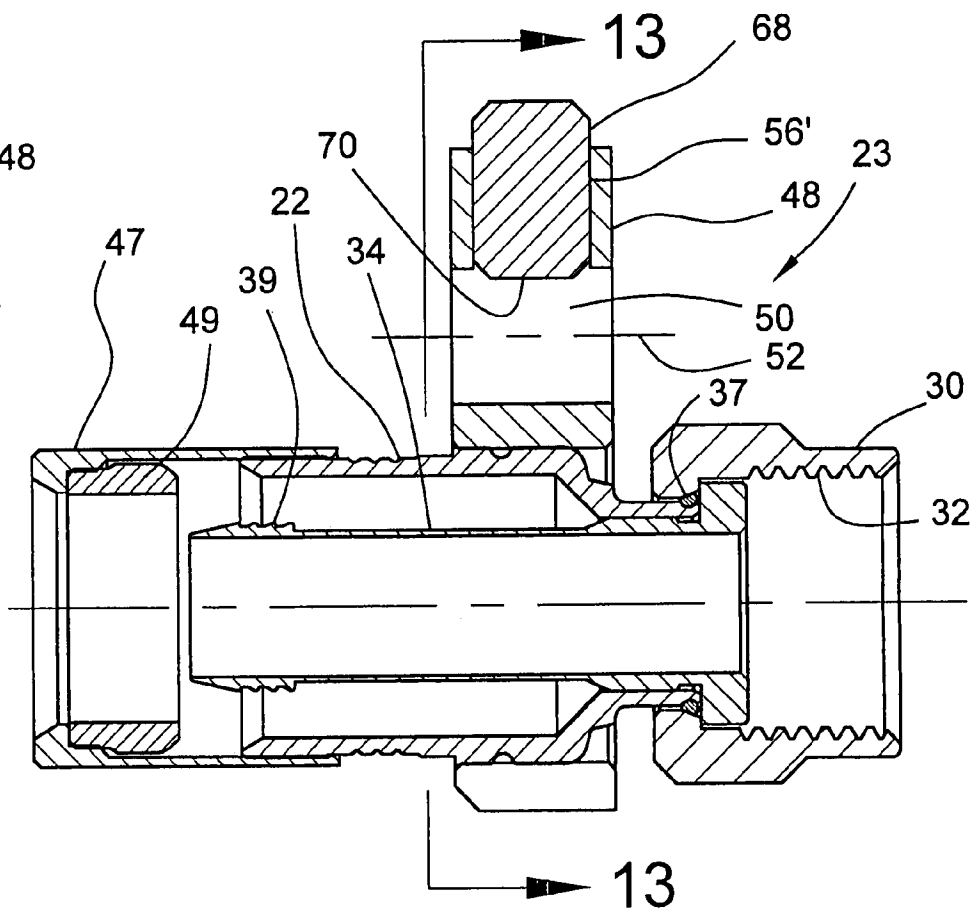
FIG. 12 is a cross-sectional view of a coaxial connector generally similar to that shown in FIG. 1 but wherein a press-fit pin is used to clamp the grounding wire in lieu of a grounding screw.
Figure 13:
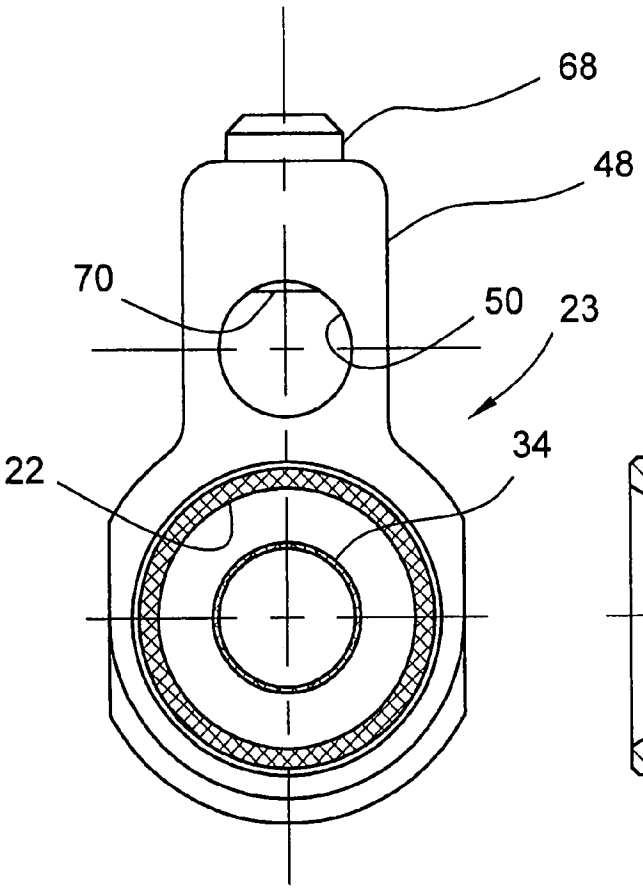
FIG. 13 is a partial sectional view of the coaxial connector shown in FIG. 12, taken through the lines 13-13 shown in FIG. 12.

In the embodiments of the present invention described above, grounding wire 54 is clamped within lug 48 by a threaded grounding screw. However, those skilled in the art will appreciate that other clamping mechanisms may be used to clamp grounding wire 54 within lug 48. For example, turning to FIGS. 12 and 13, an alternate embodiment of a coaxial connector 23 is shown wherein a press-fit clamping pin 68 is inserted within smooth-walled second hole 56' in grounding lug 48. Grounding wire 54 is inserted into first hole 50 of grounding lug 48, and then press-fit clamping pin 68 is further advanced, as by a compression tool, into second hole 56' until the lower end 70 of pin 68 clamps grounding wire 54 in place. Press-fit clamping pin 68 frictionally-engages the surrounding cylindrical wall of second hole 56', and is difficult to back-out once it is advanced within second hole 56', thereby lessening the risk that an unauthorized person will remove grounding wire 54 from connector 23.

Figure 4A:
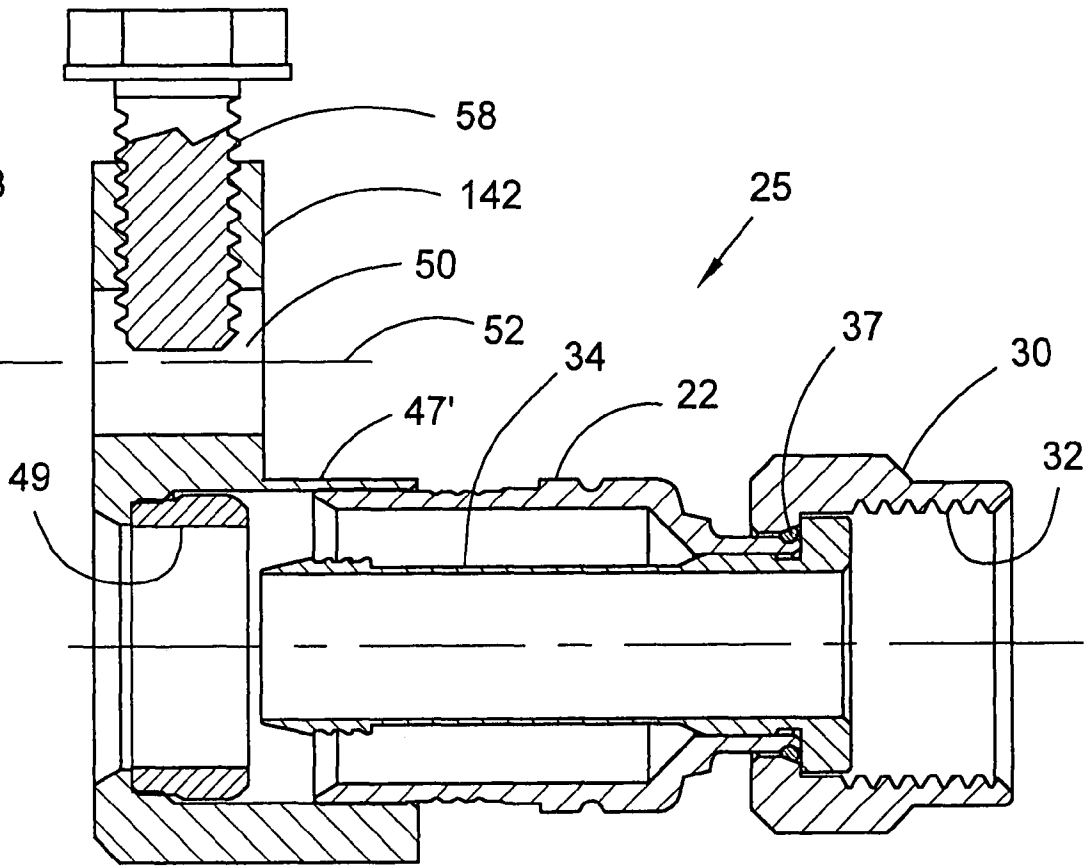
FIG. 4A is a cross-sectional drawing of an alternate embodiment of the present invention wherein the bonding block lug is incorporated within the compression ring of the coaxial cable connector.
Figure 4B:
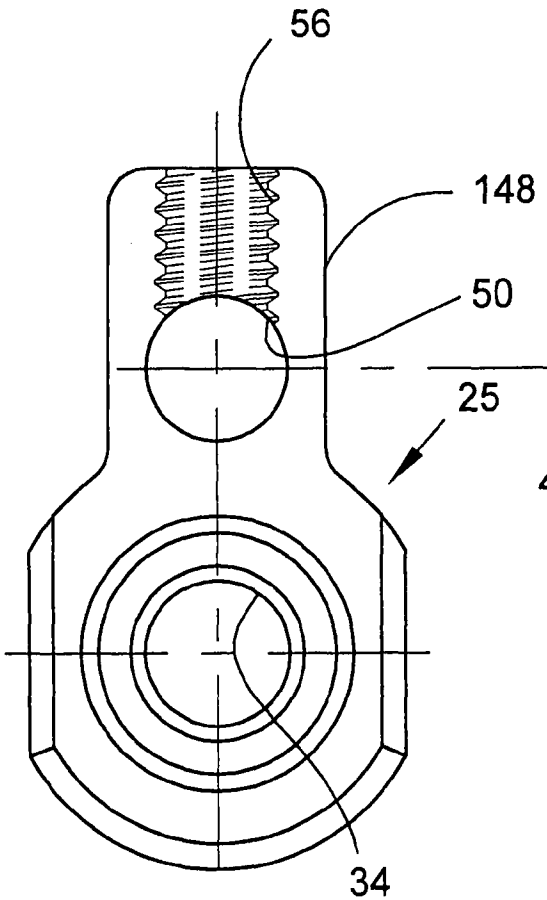
FIG. 4B is an end view of the coaxial connector shown in FIG. 4A.

Within the embodiments of the present invention described above, grounding lug 48 has been described as being directly secured to body portion 22, or integral therewith. It is also possible to secure grounding lug 48 to compression sleeve 47, if desired. Turning to FIGS. 4A and 4B, coaxial connector 25 is shown in accordance with an alternate embodiment of the present invention wherein grounding lug 148 is formed integrally with compression sleeve 47'. As before, first hole 50 is a through-hole for receiving a grounding wire, and second hole 56 receives a clamping element, e.g., threaded grounding screw 58, for securing the grounding wire within first hole 50. Compression sleeve 47 and gripping member 49 function in the same manner as already described above to secure a coaxial cable to coaxial connector 25. While FIGS. 4A and 4B illustrate grounding lug 148 being integrally formed with compression sleeve 47', grounding lug 148 could be formed as a separate component and press-fit over compression sleeve 47, in a manner similar to that already described above in regard to FIG. 8. Grounding lug 148, compression sleeve 47', and body portion 22 are all electrically conductive, and in mutual electrical contact with each other. The braid or outer conductor is in electrical contact with the sleeve 47 and/or body portion 22, directly or indirectly.

Figure 6:
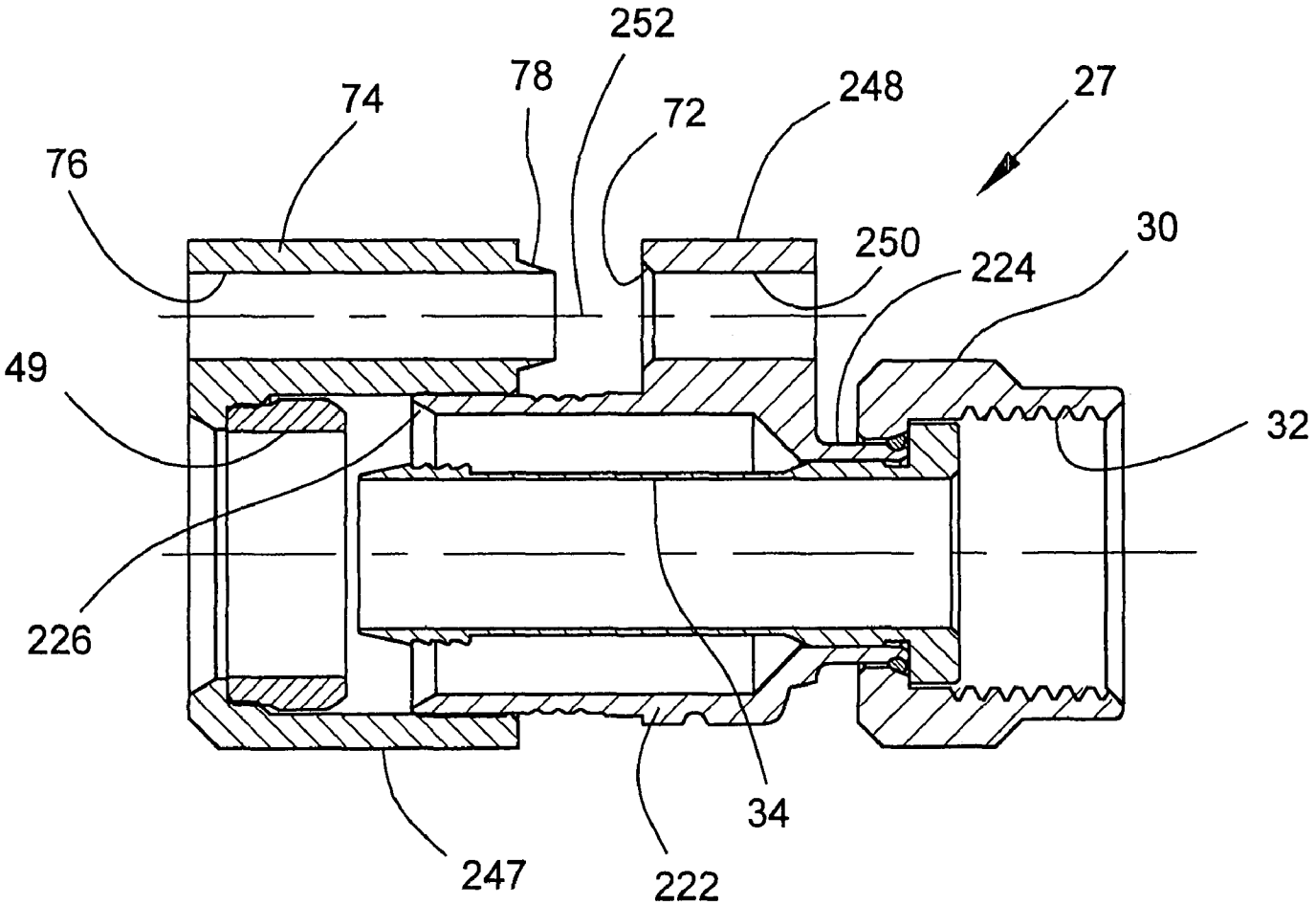
FIG. 6 is a cross-sectional drawing of an alternate embodiment of the present invention shown without a grounding screw, and wherein the bonding block lug is formed by two cooperating lugs that radially compress the grounding wire as the coaxial connector is axially compressed about the coaxial cable.
Figure 7:
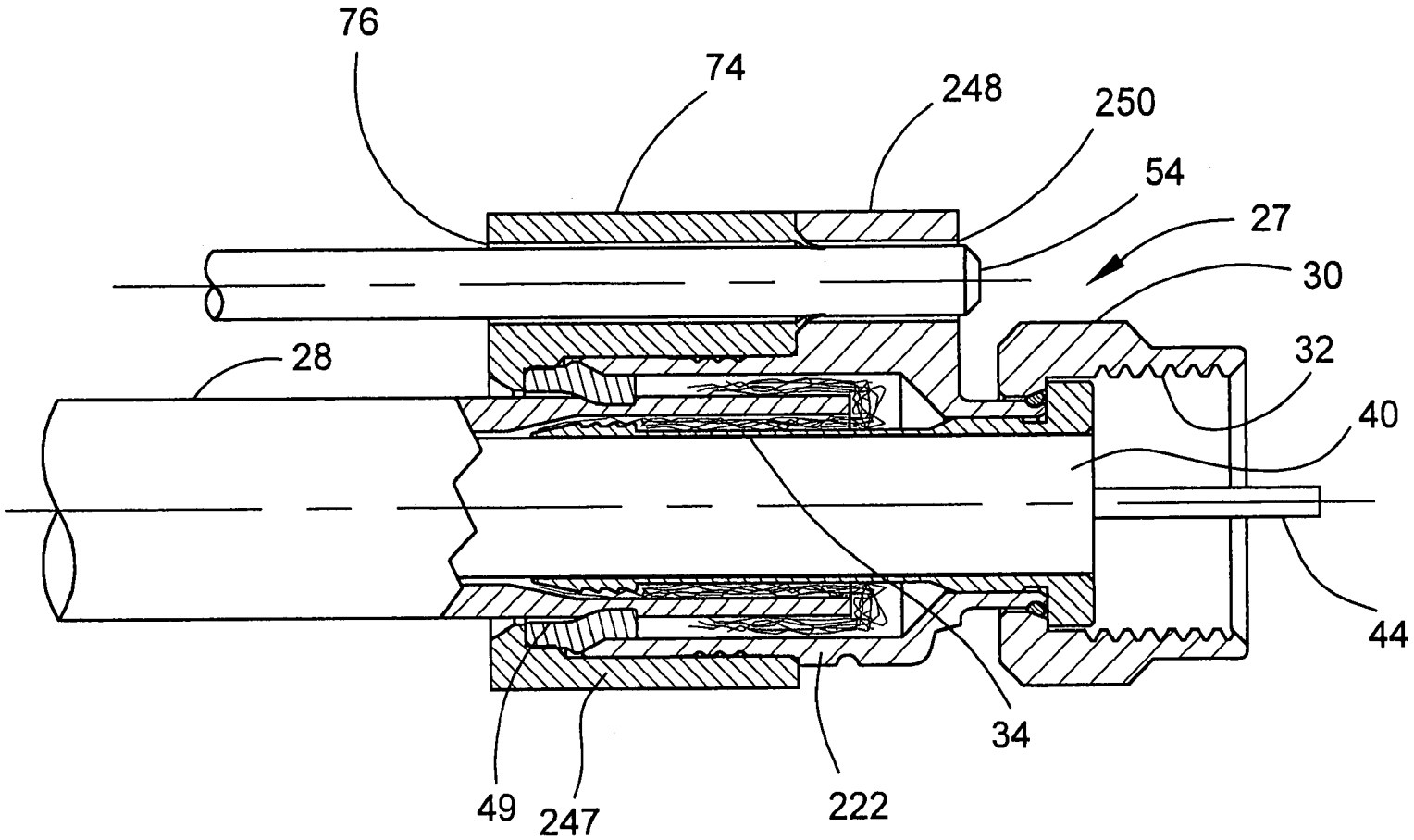
FIG. 7 is a cross-sectional drawing of the coaxial cable connector of FIG. 6 following insertion of the prepared end of a coaxial cable therein, insertion of a grounding wire within the two-piece grounding lug, and axial compression of the assembly.

A further alternate embodiment of the present invention is shown in FIGS. 6 and 7 wherein a clamping element (grounding screw, press-fit pin, or the like) is omitted. Coaxial cable connector 27 has features similar to those described above in conjunction with coaxial connector 20 of FIGS. 1-3, and identical reference numerals are used to identify similar features. Connector 27 includes a body portion 222 having first and second opposing ends 224 and 226. As in the case of connector 20, second end 226 of body portion 222 is adapted to receive the prepared end of a coaxial cable 28. Body portion 222 includes a first lug member 248 secured thereto and in electrical contact therewith. As shown in FIGS. 6 and 7, first lug 248 is preferably integrally formed with body portion 222. First lug member 248 includes a through-hole 250 for receiving grounding wire 54. The end of hole 250 that faces away from coupler 30 preferably has an inwardly-tapered, frusto-conical opening 72 that initially has an inner diameter larger than that of hole 250.

Connector 27 also includes a modified compression sleeve 247 that is slidably secured over second end 226 of body portion 222. Compression sleeve 247 includes gripping member 49 housed therein, and axial compression of compression sleeve 247 relative to body portion 222 secures the prepared end of coaxial cable 28 within connector 27 in the manner already described above. Compression sleeve 247 includes a second lug member 74 having a second through-hole 76 that is axially aligned with the first through-hole 250 in first lug member 248 along axis 252. Second through-hole 76 also serves to receive the grounding wire 54. Second lug member 74 preferably includes a tapered port, forming a conical section 78, surrounding the end of second through-hole 76 that faces first lug member 248.

Conical section 78 is adapted to enter into tapered opening 72 of first through-hole 250 as compression sleeve 247 is axially advanced toward coupler 30. As shown in FIG. 7, during such axial compression operation, the extreme end of cone or conical section 78 is preferably compressed radially inwardly against grounding wire 54 by the tapered surface 72 of first through-hole 250 of first lug member 248 for securely gripping grounding wire 54. Thus, in a single axial compression operation, cable 28 is secured within connector 27, and grounding wire 54 is secured within grounding lugs 248 and 74. While first grounding lug 248 is shown in FIGS. 6 and 7 as being integrally formed with body portion 222, first grounding lug 248 could be separately fabricated and secured to body portion 222 by a press-fit or the like. Similarly, though second grounding lug 74 is shown in FIGS. 6 and 7 as being integrally formed with compression sleeve 247, second grounding lug 74 could be separately fabricated and secured to compression sleeve 247 by a press-fit or the like.

Figure 9:
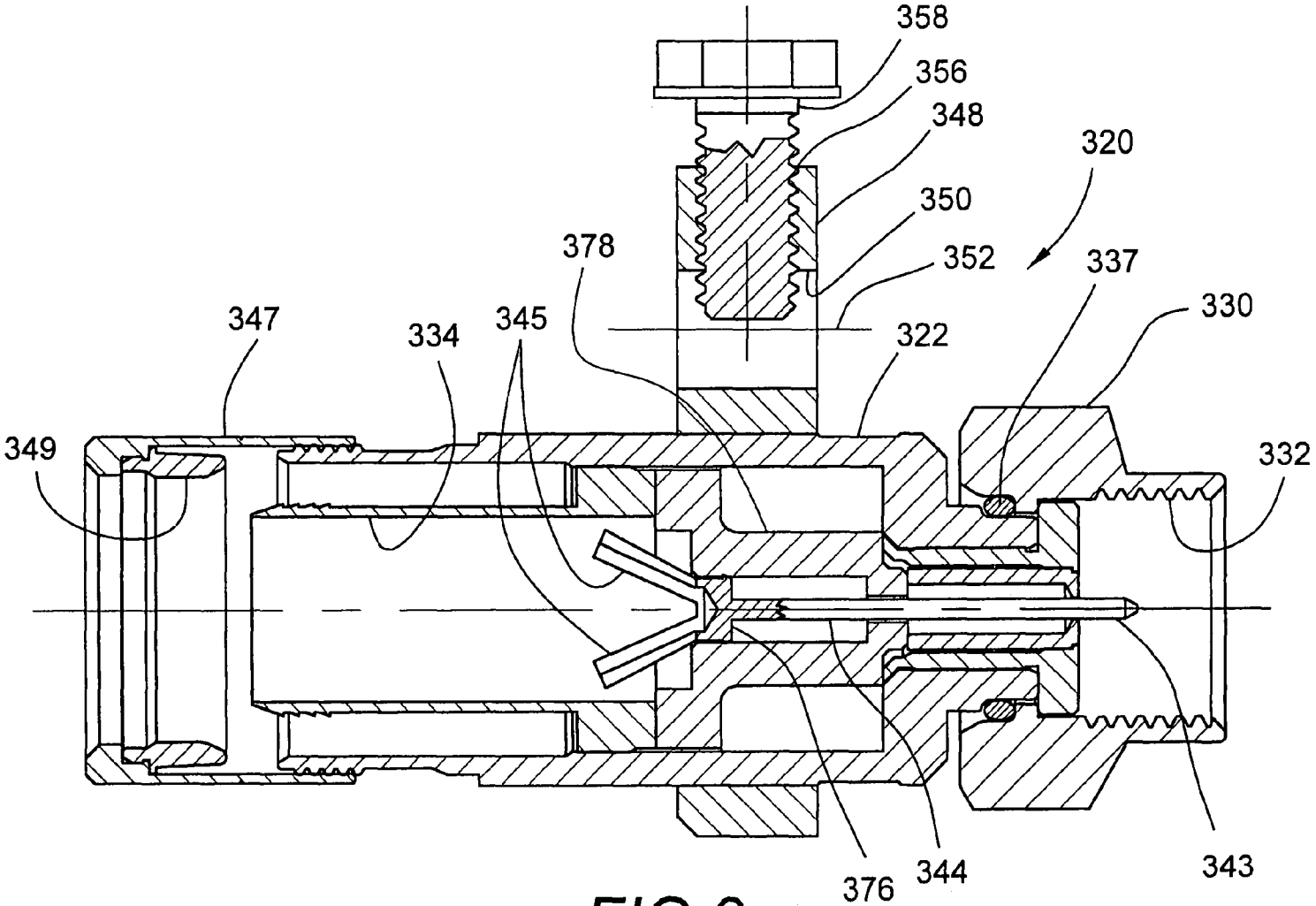
FIG. 9 is a cross-sectional view of a so-called "pop-up-pin" connector incorporating a grounding lug in accordance with the present invention.

Thus far, the present invention has been described for use with a conventional CATV F-connector of the type which is designed to permit the bared center conductor 44 to extend through coupler 30 for coupling directly with a center contact of a coaxial equipment port. However, as shown in FIG. 9, the grounding lug described above may also be incorporated with other types of coaxial connectors. In FIG. 9, a so-called "pop-up pin" style coaxial connector 320 is shown including a slidable integral center pin 344. A first end 343 of center pin 344 is selectively advanced to extend within coupler 330 to engage a center terminal of the mating coaxial port. The second end 345 of slidable center pin 344 includes a series of gripping fingers 345 initially disposed radially outwardly, as shown in FIG. 9, to receive the bared end of the center conductor of the coaxial cable (not shown). Gripping fingers 345 are connected to a hub 376 that is slidably supported within dielectric 378. As the prepared end of the coaxial cable is further advanced into connector 320, the coaxial cable pushes center pin 344 outwardly (i.e., to the right in FIG. 9), thereby advancing first end 343 to partially pop out of coupler 330, while gripping fingers 345 collapse or close inwardly around the bared center conductor of the coaxial cable to grip and engage such center conductor.

Still referring to FIG. 9, compression sleeve 347 and gripping member 349 are then axially compressed in the manner described above to secure the end of the coaxial cable to connector 320. Ground lug 348 is preferably press-fit, or otherwise secured, over body portion 322. The grounding wire is inserted into through-hole 350, and grounding screw 358 is rotated in threaded hole 356 to clamp the grounding wire within lug 348.

Figure 11:
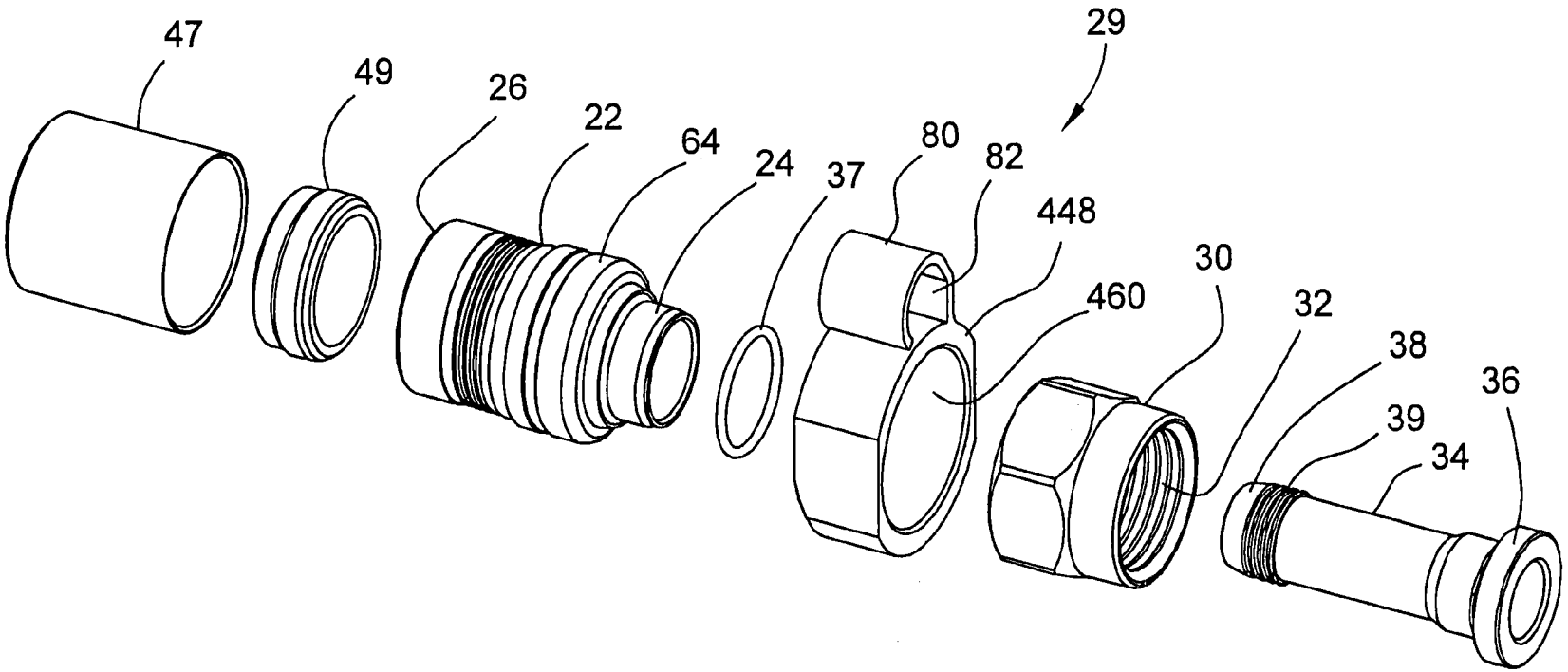
FIG. 11 is an exploded perspective view of an alternative embodiment of the present invention using a deformable grounding lug that can be crimped around a grounding wire.

FIG. 11 shows yet another form of grounding lug in accordance with another embodiment of the present invention. Coaxial cable connector 29 has features similar to those described above in conjunction with coaxial connector 20 of FIGS. 1-3 and FIG. 8, and identical reference numerals are used to identify corresponding features. Connector 29 includes coupler 30, body portion 22, tubular post 34, O-ring 37, compression sleeve 47, and gripping member 49 as described above relative to FIGS. 1-3 and FIG. 8. Connector 29 includes a modified form of grounding lug 448 which includes a central bore 460 that is press-fit over enlarged shoulder 64 of body portion 22. Rather than drilling a through-hole in lug 448 for receiving the grounding wire, lug 448 includes a crimp-able loop, or deformable lug, 80 which extends from the main body of grounding lug 48 and curls around to form a through-hole 82 into which a grounding wire may be passed. An electrical connector crimp tool is then used to compress, or crimp, loop 80 around the grounding wire. This embodiment provides the advantages of reduced cost, ease of use, and forms a relatively tamper-proof connection of the grounding wire to the connector.

Figure 14:
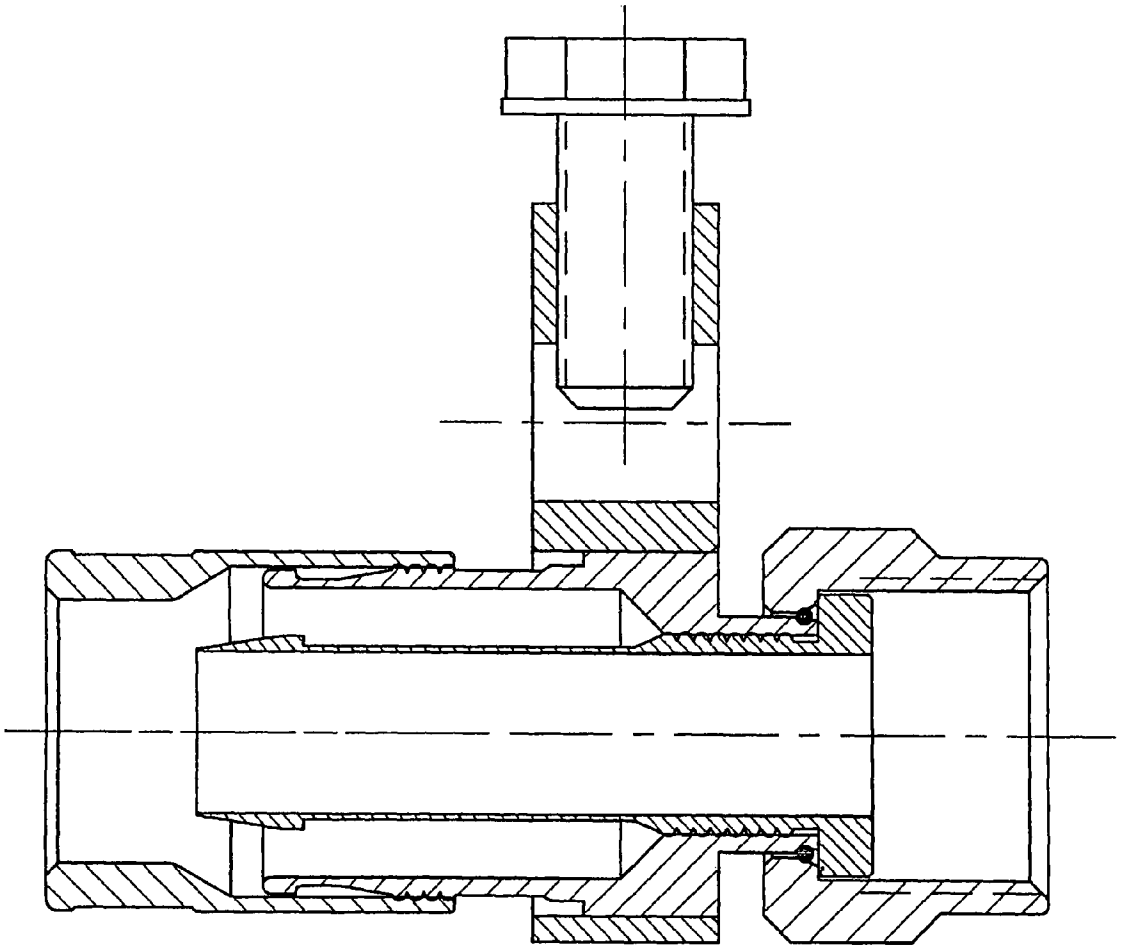
FIG. 14 is a cross-sectional view of an alternate embodiment of the present invention.

FIG. 14 is a cross-sectional view of an alternate embodiment of the present invention. The tubular body, here a compression sleeve, radially displaces a portion of the cylindrical body radially inwardly to engage the cable.

Those skilled in the art will now appreciate that an improved form of coaxial connector including a grounding wire bonding block has been described that can be installed quickly and easily with conventional CATV installation tools. The disclosed coaxial connector reduces the number of coaxial interconnections that would otherwise be required to connect a grounding wire to a coaxial cable transmission system. This reduction in the number of interconnections inherently improves system reliability and lowers system cost. Because the coaxial connector of the present invention itself provides a grounding wire bonding block, it eliminates the need for mounting a separate bonding block to a substructure. This saves an installer considerable time and effort by eliminating the need to locate and drill mounting holes, and the need to install separate mounting hardware. Moreover, because the grounding wire lug is incorporated as part of a coaxial connector, the addition of a grounding wire can be achieved with significantly-reduced physical mounting space. This can result in allowing installation of the grounding wire within the protected environment inside of a Network Interface Device (NID), rather than outside of an NID, thereby reducing exposure to the elements while improving the appearance of an installation on a customer's home. In addition, by using one of the tamper-proof methods of securing the grounding wire to the grounding lug, as discussed above, removal of the grounding wire by unauthorized persons is less likely, improving customer safety.

In one aspect, a coaxial cable connector is disclosed herein which is adapted to receive a grounding wire, the coaxial cable connector including: a body portion having first and second opposing ends, the second end of the body portion being adapted to receive an end of a coaxial cable; a nut rotatably secured about the first end of the body portion for securing the coaxial cable connector to a mating coaxial port; a post extending within the body portion, the post having a first end secured to the first end of the body portion, the post having an opposing second end for extending within a coaxial cable; a lug secured to the body portion and in electrical contact therewith, the lug including a first hole for receiving the grounding wire; and a clamp element communicating with the first hole of the lug for clamping the grounding wire therein, wherein the coaxial cable connector is capable of connecting the end of the coaxial cable to the coaxial port, and the clamp element secures a grounding wire within the first hole of the lug.

The lug can include a second hole that intersects the first hole of the lug, wherein the clamp element extends within the second hole for selectively engaging a grounding wire in the first hole of the lug. The second hole can be threaded, wherein the clamp element is a threaded grounding screw for threadedly-engaging the second hole. The grounding screw can have a break-away head that fractures after the grounding screw has been sufficiently tightened to clamp the grounding wire within the first hole of the lug, thereby preventing unauthorized personnel from loosening the grounding screw thereafter. In some embodiments, the second hole is relatively smooth, and the clamp element is a press-fit pin for frictionally-engaging the second hole.

The lug can be press-fit over the body portion of the coaxial cable connector. In other embodiments, the lug is integral with the body portion of the coaxial cable connector.

In some embodiments, the coaxial cable includes an outer conductor and an outer protective jacket, and the coaxial cable connector further includes an electrically-conductive compression ring slidably secured over the second end of the body portion, and axially movable with respect thereto, for compressing the outer protective jacket and outer conductor against the second end of the post as the compression ring is axially advanced toward the nut, the lug being secured to, and in electrical contact with, the compression ring, and the compression ring being in secured to, and in electrical contact with, the body portion of the coaxial cable connector.

In some embodiments, the coaxial cable includes a center conductor, and the coaxial cable connector includes a slidable center conductor pin extending between first and second opposing ends, the first end of the slidable center conductor pin selectively being advanced to extend within the nut to engage a center conductor of the coaxial port, the second end of the slidable center conductor being adapted to receive and engage the center conductor of the coaxial cable.

In another aspect, a coaxial cable connector is disclosed herein which is adapted to terminate a coaxial cable, the coaxial cable including an inner conductor, an outer conductor, and a protective jacket surrounding the outer conductor, the coaxial cable connector also being adapted to receive a grounding wire, the coaxial cable connector including: a body portion having first and second opposing ends, the second end of the body portion being adapted to receive a prepared end of a coaxial cable, the body portion including a first lug member secured to the body portion and in electrical contact therewith, the first lug member including a first hole for receiving a grounding wire; a nut rotatably secured about the first end of the body portion for securing the coaxial cable connector to a mating coaxial port; a post extending within the body portion, the post having a first end secured to the first end of the body portion, the post having an opposing second end for extending within a coaxial cable; a compression ring slidably secured over the second end of the body portion, and axially movable with respect thereto, for compressing the outer protective jacket and outer conductor against the second end of the post as the compression ring is axially advanced toward the nut; the compression ring including a second lug member having a second hole axially aligned with the first hole in the first lug member, the second hole of the second lug member also serving to receive the grounding wire, the second lug member including a tapered port surrounding the second hole and adapted to enter the first hole as the compression ring is axially advanced toward the nut, the tapered port being compressed inwardly by the first hole of the first lug member for gripping the grounding wire.

In some embodiments, the first lug member is integral with the body portion of the coaxial cable connector. The second lug member can be integral with the compression ring of the coaxial cable connector.

In other embodiments, the second lug member is integral with the compression ring of the coaxial cable connector.

In another aspect, a coaxial cable connector is disclosed herein which is adapted to receive a grounding wire, the coaxial cable connector including: a body portion having first and second opposing ends, the second end of the body portion being adapted to receive a prepared end of a coaxial cable; a nut rotatably secured about the first end of the body portion for securing the coaxial cable connector to a mating coaxial port; a post extending within the body portion, the post having a first end secured to the first end of the body portion, the post having an opposing second end for extending within a coaxial cable; a deformable lug secured to the body portion and in electrical contact therewith, the deformable lug including a first passage for receiving a grounding wire, and being deformable for being crimped about the grounding wire; wherein the coaxial cable connector connects the prepared end of a coaxial cable to a coaxial port, and the deformable lug secures a grounding wire in electrical contact with the body portion of the coaxial connector. The deformable lug can be press-fit over the body portion of the coaxial cable connector.

In yet another aspect, a coaxial cable connector is disclosed herein, for connecting a coaxial cable to a mating coaxial port, and adapted to receive a grounding wire, the coaxial cable connector comprising: a connector base for securing the connector to the cable, the connector base having first and second opposing ends, the second end being adapted to receive the coaxial cable; a coupler, secured about the first end of the connector base, for securing the coaxial cable connector to the mating coaxial port; wherein the connector base comprises a lug comprising an opening for receiving the grounding wire; wherein the connector base provides an electrically conductive path from the coaxial cable to the lug, whereby the connector is capable of providing an electrically conductive path from the coaxial cable to the grounding wire. In some embodiments, the opening in the lug is a through hole. In some embodiments, the through hole is disposed parallel to the longitudinal axis of the connector base. In some embodiments, the grounding wire lies generally parallel to the coaxial cable. The lug may comprise a lock for securing the grounding wire to the lug. The lock may comprise a clamping element, or a set screw, or a pin. In some embodiments, the lock comprises a deformable portion capable of being deformed into contact with the grounding wire. In some embodiments, the connector base comprises a cylindrical body. In some embodiments, the lug protrudes from the cylindrical body. The connector base may further comprise a tubular post in contact with the cylindrical body. In some embodiments, the connector base further comprises a tubular post in contact with the cylindrical body, and the tubular post, the cylindrical body, and the lug provide the electrically conductive path. In some embodiments, the connector base further comprises a center pin disposed at least partially within the cylindrical body. In some embodiments, the connector base comprises a cylindrical body and a mating tubular body capable of being axially displaced toward each other. In some embodiments, the tubular body comprises a compression sleeve adapted to engage the coaxial cable with a radially compressive force upon axial displacement of the cylindrical body and the tubular body toward each other. In some embodiments, the tubular body comprises a deformable gripping member capable of being radially displaced to engage the cable. In some embodiments, the tubular body radially displaces a portion of the cylindrical body radially inwardly to engage the cable. In some embodiments, the lug protrudes from the cylindrical body, and in other embodiments, the lug protrudes from the tubular body.

In some embodiments, a first lug protrudes from the cylindrical body and a second lug protrudes from the tubular body, wherein the first and second lugs are capable of being axially displaced toward each other. In some embodiments, the first and second lugs are capable of mutual engagement, and at least one of the first and second lugs comprises a lip portion capable of being displaced radially inwardly upon mutual engagement, wherein the lip portion is capable of contacting and securing the grounding wire. Either the first lug, or the second lug, or both, may be electrically conductive.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

We claim:

1. A coaxial cable connector adapted to terminate a coaxial cable, the coaxial cable including an inner conductor, an outer conductor, and a protective jacket surrounding the outer conductor, the coaxial cable connector also being adapted to receive a grounding wire, the coaxial cable connector including:

a. a body portion having first and second opposing ends, the second end of the body portion being adapted to receive a prepared end of a coaxial cable, the body portion including a first lug member secured to the body portion and in electrical contact therewith, the first lug member including a first hole for receiving a grounding wire;

b. a nut rotatably secured about the first end of the body portion for securing the coaxial cable connector to a mating coaxial port;

c. a post extending within the body portion, the post having a first end secured to the first end of the body portion, the post having an opposing second end for extending within a coaxial cable; and d. a compression ring slidably secured over the second end of the body portion, and axially movable with respect thereto, for compressing the outer protective jacket and outer conductor against the second end of the post as said compression ring is axially advanced toward the nut;

wherein the compression ring includes a second lug member having a second hole axially aligned with the first hole in said first lug member, the second hole of the second lug member also serving to receive the grounding wire, the second lug member including a tapered port surrounding the second hole and adapted to enter the first hole as the compression ring is axially advanced toward the nut, the tapered port being compressed inwardly by the first hole of the first lug member for gripping the grounding wire.

2. The coaxial cable connector as recited by claim 1 wherein said second lug member is integral with the compression ring of the coaxial cable connector.

3. The coaxial cable connector as recited by claim 1 wherein said first lug member is integral with the body portion of the coaxial cable connector.

4. The coaxial cable connector as recited by claim 3 wherein said second lug member is integral with the compression ring of the coaxial cable connector.

5. A coaxial cable connector adapted to receive a grounding wire, the coaxial cable connector including:

a. a body portion having first and second opposing ends, the second end of the body portion being adapted to receive a prepared end of a coaxial cable;

b. a nut rotatably secured about the first end of the body portion for securing the coaxial cable connector to a mating coaxial port;

c. a post extending within the body portion, the post having a first end secured to the first end of the body portion, the post having an opposing second end for extending within a coaxial cable; and d. a deformable lug secured to the body portion and in electrical contact therewith, the deformable lug including a first passage for receiving a grounding wire, and being deformable for being crimped about the grounding wire;

wherein the coaxial cable connector connects the prepared end of a coaxial cable to a coaxial port, and the deformable lug secures a grounding wire in electrical contact with the body portion of the coaxial connector.

6. The coaxial cable connector as recited by claim 5 wherein said deformable lug is press-fit over the body portion of the coaxial cable connector.

7. A coaxial cable connector, for connecting a coaxial cable to a mating coaxial port, and adapted to receive a grounding wire, the coaxial cable connector comprising:

a single-piece connector base for securing the connector to the cable, the connector base having first and second opposing ends, the second end being adapted to receive the coaxial cable and a coupler, secured about the first end of the connector base, for securing the coaxial cable connector to the mating coaxial port;

wherein the connector base comprises a lug comprising an opening for receiving the grounding wire; and wherein an electrically conductive path is provided from the coaxial cable to the lug;

whereby the connector is capable of providing an electrically conductive path from the coaxial cable to the grounding wire.

8. The coaxial connector of claim 7 wherein the opening in the lug is a through hole.

9. The coaxial connector of claim 7 wherein through hole is disposed parallel to the longitudinal axis of the connector base.

10. The coaxial connector of claim 7 wherein the grounding wire lies generally parallel to the coaxial cable.

11. The coaxial connector of claim 7 wherein the lock comprises a clamping element, a set screw, or a pin.

12. The coaxial connector of claim 7 wherein the lug comprises a lock for securing the grounding wire to the lug.

13. The coaxial connector of claim 12 wherein the lock comprises a deformable portion capable of being deformed into contact with the grounding wire.

14. A coaxial cable connector adapted to receive a grounding wire, the coaxial cable connector including:

a. a single-piece body portion having first and second opposing ends, the second end of the body portion being adapted to receive an end of a coaxial cable, the body portion comprising an integral lug including a first hole for receiving the grounding wire;

b. a coupler secured about the first end of the body portion;

c. a post extending within the body portion, the post having a first end secured to the first end of the body portion, the post having an opposing second end for extending within a coaxial cable; and d. a clamp element communicating with the first hole of the lug for clamping the grounding wire therein.

15. The coaxial cable connector as recited by claim 14 wherein the coaxial cable includes an outer conductor and an outer protective jacket, and wherein said coaxial cable connector further includes an electrically-conductive compression ring slidably secured over the second end of the body portion, and axially movable with respect thereto, for compressing the outer protective jacket and outer conductor against the second end of the post as said compression ring is axially advanced toward the nut, said lug being secured to, and in electrical contact with, the compression ring, and the compression ring being in secured to, and in electrical contact with, the body portion of the coaxial cable connector.

16. The coaxial cable connector as recited by claim 14 wherein the coaxial cable includes a center conductor, and wherein the coaxial cable connector includes a slidable center conductor pin extending between first and second opposing ends, the first end of the slidable center conductor pin selectively being advanced to extend within the nut to engage a center conductor of the coaxial port, the second end of the slidable center conductor being adapted to receive and engage the center conductor of the coaxial cable.

17. The coaxial cable connector as recited by claim 14 wherein said lug includes a second hole that intersects the first hole of said lug, and wherein the clamp element extends within the second hole for selectively engaging a grounding wire in the first hole of said lug.

18. The coaxial cable connector as recited by claim 17 wherein the second hole is relatively smooth, and wherein said clamp element is a press-fit pin for frictionally-engaging the second hole.

19. The coaxial cable connector as recited by claim 17 wherein the second hole is threaded, and wherein said clamp element is a threaded grounding screw for threadedly-engaging the second hole.

20. The coaxial cable connector as recited by claim 19 wherein said grounding screw has a break-away head that fractures after said grounding screw has been sufficiently tightened to clamp the grounding wire within the first hole of said lug, thereby preventing unauthorized personnel from loosening the grounding screw thereafter.

21. A coaxial cable connector adapted to receive a grounding wire, the coaxial cable connector including:

a. a body portion having first and second opposing ends, the second end of the body portion being adapted to receive an end of a coaxial cable;

b. a coupler secured about the first end of the body portion;

c. a post extending within the body portion, the post having a first end secured to the first end of the body portion, the post having an opposing second end for extending within a coaxial cable;

d. a lug secured to the body portion and in electrical contact therewith, the lug including a first hole for receiving the grounding wire and a second hole that intersects the first hole of said lug; and e. a clamp element communicating with the first hole of the lug for clamping the grounding wire therein;

wherein the clamp element extends within the second hole for selectively engaging a grounding wire in the first hole of said lug, and wherein said clamp element is a press-fit pin for frictionally-engaging the second hole.

22. A coaxial cable connector adapted to receive a grounding wire, the coaxial cable connector including:

a. a body portion having first and second opposing ends, the second end of the body portion being adapted to receive an end of a coaxial cable, the coaxial cable including an outer conductor and an outer protective jacket;

b. a coupler secured about the first end of the body portion;

c. a post extending within the body portion, the post having a first end secured to the first end of the body portion, the post having an opposing second end for extending within a coaxial cable;

d. a lug secured to the body portion and in electrical contact therewith, the lug including a first hole for receiving the grounding wire;

e. a clamp element communicating with the first hole of the lug for clamping the grounding wire therein;

f. an electrically-conductive compression ring slidably secured over the second end of the body portion, and axially movable with respect thereto, for compressing the outer protective jacket and outer conductor against the second end of the post as said compression ring is axially advanced toward the coupler, said lug being secured to, and in electrical contact with, the compression ring, and the compression ring being in secured to, and in electrical contact with, the body portion of the coaxial cable connector.

23. A coaxial cable connector, for connecting a coaxial cable to a mating coaxial port, and adapted to receive a grounding wire, the coaxial cable connector comprising:

a connector base for securing the connector to the cable, the connector base having first and second opposing ends, the second end being adapted to receive the coaxial cable and a coupler, secured about the first end of the connector base, for securing the coaxial cable connector to the mating coaxial port;

wherein the connector base comprises a lug comprising an opening for receiving the grounding wire;

wherein the lug comprises a lock for securing the grounding wire to the lug;

wherein the lock comprises a deformable portion capable of being deformed into contact with the grounding wire; and wherein an electrically conductive path is provided from the coaxial cable to the lug;

whereby the connector is capable of providing an electrically conductive path from the coaxial cable to the grounding wire.

* * * * *